US012416311B2

(12) United States Patent
Traverso et al.

(10) Patent No.: US 12,416,311 B2
(45) Date of Patent: Sep. 16, 2025

(54) SYSTEM AND METHOD FOR COMPRESSOR PERFORMANCE MONITORING AND SURGE DETECTION

(71) Applicants: SIT Technologies S.r.l., Genoa (IT); Alberto Traverso, Novi Ligure (IT); Paolo Silvestri, Genoa (IT); Carlo Alberto Niccolini, Genoa (IT)

(72) Inventors: Alberto Traverso, Novi Ligure (IT); Paolo Silvestri, Genoa (IT); Federico Reggio, Genoa (IT); Carlo Alberto Niccolini, Genoa (IT); Marco Ferrando, Genoa (IT); William T. Cousins, East Hartford, CT (US); Raffaele Spezia, Genoa (IT)

( * ) Notice: Subject to any disclaimer, the term of this patent is extended or adjusted under 35 U.S.C. 154(b) by 0 days.

(21) Appl. No.: 19/004,286

(22) Filed: Dec. 28, 2024

(65) Prior Publication Data

US 2025/0215886 A1 Jul. 3, 2025

(30) Foreign Application Priority Data

Dec. 29, 2023 (IT) ..... 102023000028416

(51) Int. Cl.
*F04D 27/02* (2006.01)
*F04D 25/06* (2006.01)

(52) U.S. Cl.
CPC ..... *F04D 27/02* (2013.01); *F04D 25/06* (2013.01); *F04D 27/0292* (2013.01)

(58) Field of Classification Search
CPC ..... F04D 27/02; F04D 25/06; F04D 27/0292
See application file for complete search history.

(56) References Cited

U.S. PATENT DOCUMENTS

| | | | | |
|---|---|---|---|---|
| 4,581,900 | A | 4/1986 | Lowe et al. | |
| 5,894,736 | A * | 4/1999 | Beaverson | F04D 25/06 62/230 |
| 8,087,870 | B2 * | 1/2012 | Flucker | F04D 27/0261 415/1 |
| 8,631,657 | B2 * | 1/2014 | Hagen | F01K 23/101 60/39.181 |
| 9,328,949 | B2 * | 5/2016 | Blaiklock | F04D 27/0261 |
| 10,961,919 | B2 | 3/2021 | Beauchesne-Martel et al. | |

(Continued)

FOREIGN PATENT DOCUMENTS

EP 2414748 11/2019

OTHER PUBLICATIONS

Italian Patent and Trademark Office, Search Report, Jun. 25, 2024.

(Continued)

*Primary Examiner* — Shafiq Mian
(74) *Attorney, Agent, or Firm* — Themis Law

(57) ABSTRACT

In one embodiment, a method and a system for determining the operating state of a dynamic compressor that is mechanically connected to an electrical machine and that is equipped with a rotor that exchanges energy with a known fluid by rotating at a speed and with a driving mechanical torque, and in particular for determining the operating point of the dynamic compressor and the distance of the operating point (Continued)

from a surge limit curve, which delimits a stable operation zone from an unstable operation zone of the dynamic compressor.

14 Claims, 9 Drawing Sheets

(56) References Cited

U.S. PATENT DOCUMENTS

| | | | | |
|---|---|---|---|---|
| 2006/0067833 | A1* | 3/2006 | McAuliffe | F04D 29/584 417/43 |
| 2017/0097005 | A1* | 4/2017 | Hossain | F04D 29/05 |
| 2019/0063331 | A1* | 2/2019 | Beauchesne-Martel | F02K 3/04 |

OTHER PUBLICATIONS

A. Traverso, "TRANSEO: a New Simulation Tool for Transient Analysis of In-novative Energy Systems", 2004, Ph.D. Thesis, DiMSET, Università di Genova, Genova, Italy.

Munari, E., Morini, M., Pinelli, M., Spina, P.R., Suman, A., "Experimental Inves-tigation of Stall and Surge in a Multistage Compressor", ASME Paper GT2016-57168, Turbo Expo 2016, Seoul, Korea.

Kabral, R., Åbom, M., "Investigation of turbocharger compressor surge inception by means of an acoustic two-port model". Journal of Sound and Vibration 412 (2018), pp. 270-286.

Reggio F., Silvestri P., Ferrari M.L., Massardo A.F., "Operation extension in gas turbine-based advanced cycles with a surge prevention tool", (2022) Meccanica, 57 (8), pp. 2117-2130.

Guillou, E., Gancedo, M., Gutmark, E., "Experimental Investigation of Flow In-stability in a Turbocharger Ported Shroud Compressor", Journal of Turbomachinery (2016=, vol. 138/061002-1.

Ferrando, M., Reboli, T., Reggio, F., Niccolini Marmont Du Haut Champ, C. A., Silvestri, P., Traverso, A., Sishtla, V., Centrifugal compressor surge in innovative heat pump—Part 1: fluid dynamic and vibrational analysis, ASME Paper GT2023-102776, Turbo Expo 2023, Boston, US.

Zhenzhong, S., Wangzhi, Z., Xinqian, Z., "Instability detection of centrifugal compressors by means of acoustic measurements", Aerospace Science and Technology 82-83 (2018) 628-635.

Silvestri, P., Reggio, F., Niccolini Marmont Du Haut Champ, C. A., Ferrari, M. L. and Massardo, A. F., "Compressor Surge Precursors for a Turbocharger Coupled to a Pressure Vessel", Journal of Engineering for Gas Turbines and Power 144 (11) (2022), 111014.

Silvestri, P., Niccolini Marmont Du Haut Champ, C. A., Reggio, F., Ferrari, M. L. and Massardo, A. F., Vibro-acoustic responses and pressure signal analysis for early surge detection in a turbocharger compressor, ASME Paper GT2023-101699, Turbo Expo 2023, Boston, US.

* cited by examiner

SYSTEM AND METHOD FOR COMPRESSOR PERFORMANCE MONITORING AND SURGE DETECTION

FIELD OF THE INVENTION

The present invention refers to an innovative method to monitor compressor performance as well as to detect unstable behavior onset such as compressor stall or surge.

The invention provides significant advantages in the field of compressors mechanically connected to electrical machines, preferably dynamic compressors of radial or axial type, which are largely used in the refrigeration systems, heat pump systems, process industry, oil & gas industry, technical gas management including natural gas and hydrogen compression, and, in general, in all those applications managing streams of compressible vapors and gases.

BACKGROUND OF THE INVENTION

Compressors are largely used in industry as well as distributed applications to process gaseous streams, such as natural gas, refrigerants, technical gases. When low volumetric flows are required, volumetric type compressors are typically employed, while when large volumetric flows need to be managed, dynamic compressors of radial and axial types are the typical technology of choice. A crucial property of a compressor in most applications, including the refrigerant industry, is its operational flexibility, i.e. the ability to supply boost pressure at all the required operating conditions. For dynamic compressors, increasing performance and operational flexibility requires an accurate prediction and monitoring of their stability limits. In particular, compressor surge must be avoided since it causes anomalous fluctuations in mass flow rate and pressure, inducing anomalous noise and vibration responses, control problems, and likely compressor structural damaging. The characteristics of the fluid dynamic circuit incorporating the dynamic compressor significantly influence surge onset: in particular, the volume attached upstream or downstream of the compressor considerably affects the mass flow rate at which instabilities start to show up. Such experimental evidence is fundamental when compressors are employed in complex systems such as refrigeration cycles or pressurized fuel cell systems, where complex dynamic mechanisms related to interactions between interposed plenum volumes and compressor may arise. For such reasons, surge margin monitoring as well as early surge detection in axial and centrifugal compressors coupled with large volumes and heat exchangers is a key aspect which has been widely investigated in recent decades.

Systems and methods of controlling the operation of a compressor to avoid stall, surge or flutter are described in documents U.S. Pat. No. 8,087,870B2, EP 2 414 748B1, and U.S. Pat. No. 10,961,919B2.

Basing on a non-dimensional analysis approach applied to compressors, also called similitude theory, monitoring of surge margin is typically performed through the use of pseudo-dimensional parameters, such as reduced mass flow and reduced speed which are correlated to pressure ratio and efficiency, so that the compressor performance features are univocally determined. In fact, proper non-dimensional parameters should include geometrical dimensions, such as diameter or length; however, in the turbomachinery performance map representation or performance monitoring, since geometry is fixed, geometrical parameters are dropped from equations, and parameters become "pseudo-dimensional".

For instance, in [A] the following functional relationship among pseudo-dimensional parameters is obtained for dynamic compressors, assuming negligible Reynolds number effects (in such a reference Z=1 is also assumed):

$$\beta, \eta, \frac{\Delta T_0}{T_{0in}}, = F\left(\frac{\dot{m}\sqrt{ZRT_{0in}}}{p_{0in}}, \frac{N}{\sqrt{kZRT_{0in}}}, k\right) \tag{1}$$

(all symbols are detailed at the end of the present description).

The need to further reduce such general relationship to only two independent parameters, brings to alternative formulations, aiming at including, such as in [B], the k effect into the mass flow parameters:

$$\beta, \eta, \frac{\Delta T_0}{T_{0in}}, = F\left(\frac{\dot{m}\sqrt{ZRT_{0in}}}{p_{0in}} \Big/ \dot{m}_{crit}, \frac{N}{\sqrt{kZRT_{0in}}}\right) \tag{2}$$

$$\dot{m}_{crit} = \frac{\sqrt{k}}{\left(\frac{k+1}{2}\right)^{\frac{k+1}{2(k-1)}}} \tag{3}$$

The first and second independent variable of the functional relationship, second member of equation (2), are usually called reduced mass flow $\dot{m}_{red}$ and reduced rotational speed $N_{red}$.

Once the compressor map is known, including the stability line, i.e. the line intercepting each iso-speed curve in the point of minimum stable mass flow (or maximum stable pressure ratio), a surge margin can be defined. The surge margin aims at quantifying, in general, the distance of the compressor operating point from the stability line. For instance, a typical definition of surge margin is:

$$Kp = \frac{\frac{\beta_{surge}}{\dot{m}_{surge}}}{\frac{\beta}{\dot{m}}} > 1.05 - 1.10 \tag{4}$$

However, to experimentally evaluate the surge margin, several on-line measurements are required around the compressor, such as: rotational speed, inlet temperature, inlet pressure, outlet pressure, mass flow. The last measurement, mass flow, is quite critical, slow in response and typically intrusive, and it is often subject to significant error (in the 2-5% range for industrial applications). Nonetheless, mass flow measurement is required for accurate surge margin estimation. In fact, especially for radial compressors, mass flow is the most sensitive parameter close to surge margin, since pressure ratio tends to stabilize as constant, therefore not providing sufficient sensibility for surge margin estimation. However, in the technical literature, very little attention is paid to formulate stability line maps or surge margin indicators showing good linearity against at least one main independent variable: such linearity would be extremely beneficial for control purposes.

In case of compressors mechanically connected to electrical machines, an alternative approach to avoid the use of mass flow sensors to monitor compressor margin is shown in [C]. Such a patent proposes the use of a compressor map based on electrical parameters, such as the power and speed pair, or the torque and speed pair. Inlet pressure and inlet temperature are also recorded. Electric motor can be used as an actuator to avoid surge, by modifying its speed. However, such an approach presents several limitations: adjustable speed drive is required, so that constant speed operation is not covered, and compressor maps use dimensional parameters therefore lacking generality. In fact, a general representation of compressor performance and stability line should be invariant to the compressor inlet conditions and fluid properties: unless non-dimensional or pseudo-dimensional parameters are used, the performance map is valid for only one set in inlet conditions (e.g. a reference pressure, temperature and composition). Furthermore, such an approach is not applicable to compressor equipped with Inlet Guide Vanes (IGV). Finally, the patent does not consider the possible interference between the control clock of the adjustable speed driver and the fluid-dynamic phenomena occurring in the compressor: if they have comparable time scales, the resulting electrical signals may be only partially representative of compressor behavior and may be affected by electrical control logic distortions.

Aside from surge margin monitoring, which is aimed at keeping the compressor in safe and stable operating points, vibro-acoustic techniques are usually employed to detect any incipient unstable behavior of the compressor and to provide alarms or control signals (active surge control) in case compressor enters surge operation. In the literature there are numerous theoretical and experimental studies where the general aim is to extend compressor operation to the low flow range. For instance, in [D] an aeronautic turboshaft gas turbine axial-centrifugal compressor has been investigated by developing an experimental activity in operating conditions close to stability line. The test field data were investigated showing both performance and vibro-acoustic response variation towards and during surge. In [E] a thorough investigation into compressor stall and surge inception by means of an acoustic two-port model has been performed. It was found that flow instabilities due to rotating stall generate remarkable sound pressure which significantly affects overall system acoustic response. In [F] an innovative tool for real-time surge prevention in advanced gas turbine cycles has been introduced, being able to successfully predict surge inception in all operating conditions tested. In [G] an investigation into instability phenomena with particular focus on surge and rotating stall in case of a turbocharger ported shroud compressor is discussed. In [H] experimental investigation of surge in a radial compressor chiller loop is described.

In [I] it is shown that system vibro-acoustic response exhibits a dominant spectral content in the sub-synchronous frequency range arising close to incipient surge conditions that may be due to rotating stall onset. In [J] cyclostationary analysis was applied to system vibro-acoustic responses in order to deepen knowledge of fluid-dynamic instability phenomena occurring at low mass flow rates. Such a signal processing technique proved its reliability in rotating stall cell detection and early surge identification. Recently, "cepstrum" signal processing technique has been shown to provide effective insight into incipient surge detection [K]. However, all the previous approaches require the installation and high-frequency acquisition of vibro-acoustic sensors, which add to system complexity and affect reliability.

For electrically-driven compressors, technical literature shows that electrical signals may be used to detect surge occurrence. For example, in [L] the electrical current rate of change signal is used to detect surge, applied to refrigeration compressors. However, the approach has several limitations: signal processing is complex since electrical current change signal needs to be coupled with pressure change signal, max pressure rise signal, and max current signal, there is no measurement of compressor inlet temperature (which is required by the non-dimensional analysis, otherwise lacking generality), there is no use of non-dimensional or pseudo-dimensional parameters.

In [M], a similar approach is disclosed. Speed may be varied to avoid surge. Evaporator and Condenser pressures may be acquired optionally. Also this approach presents several limitations: it is restricted to variable speed motor only, compressor inlet temperature is not measured (as required by non-dimensional analysis, hence lack of generality), no mention about non-dimensional or pseudo-dimensional parameters, the microprocessor requires online tuning, to continuously adapt the surge map and related thresholds.

Hereby the referenced technical literature is listed:

[A] S. L. Dixon, Fluid Mechanics and Thermodynamics of Turbomachinery, 5th edition, 1998, Elsevier.

[B] A. Traverso, "TRANSEO: A New Simulation Tool For Transient Analysis Of Innovative Energy Systems", 2004, Ph.D. Thesis, DiMSET, Università di Genova, Genova, Italy.

[C] Compressor surge control system and method, U.S. Pat. No. 9,328,949 (2016).

[D] Munari, E., Morini, M., Pinelli, M., Spina, P. R., Suman, A., "Experimental Investigation of Stall and Surge in a Multistage Compressor", ASME Paper GT2016-57168, Turbo Expo 2016, Seoul, South Korea.

[E] Kabral, R., Åbom, M., "Investigation of turbocharger compressor surge inception by means of an acoustic two-port model". Journal of Sound and Vibration 412 (2018), pp. 270-286

[F] Reggio F., Silvestri P., Ferrari M. L., Massardo A. F., "Operation extension in gas turbine-based advanced cycles with a surge prevention tool", (2022) Meccanica, 57 (8), pp. 2117-2130.

[G] Guillou, E., Gancedo, M., Gutmark, E., "Experimental Investigation of Flow Instability in a Turbocharger Ported Shroud Compressor", Journal of Turbomachinery (2016=, Vol. 138/061002-1.

[H] Ferrando, M., Reboli, T., Reggio, F., Niccolini Marmont Du Haut Champ, C. A., Silvestri, P., Traverso, A., Sishtla, V., Centrifugal compressor surge in innovative heat pump-Part 1: fluid dynamic and vibrational analysis, ASME Paper GT2023-102776, Turbo Expo 2023, Boston, US.

[I] Zhenzhong, S., Wangzhi, Z., Xinqian, Z., "Instability detection of centrifugal compressors by means of acoustic measurements", Aerospace Science and Technology 82-83 (2018) 628-635.

[J] Silvestri, P., Reggio, F., Niccolini Marmont Du Haut Champ, C. A., Ferrari, M. L. and Massardo, A. F., "Compressor Surge Precursors for a Turbocharger Coupled to a Pressure Vessel", Journal of Engineering for Gas Turbines and Power 144 (11) (2022), 111014.

[K] Silvestri, P., Niccolini Marmont Du Haut Champ, C. A., Reggio, F., Ferrari, M. L. and Massardo, A. F., Vibro-acoustic responses and pressure signal analysis for early surge detection in a turbocharger compressor, ASME Paper GT2023-101699, Turbo Expo 2023, Boston, US.

[L] Method and apparatus for detecting surge in centrifugal compressors driven by electrical motors, U.S. Pat. No. 4,581,900 (1986).

[M] Method and apparatuses for detecting surge in centrifugal compressors, U.S. Pat. No. 5,894,736 (1999).

SUMMARY OF THE INVENTION

This invention aims at overcoming the limitations of state-of-the-art techniques for compressor stall and surge monitoring and detection, by providing an innovative and general approach applicable to compressors mechanically connected to electrical machines, operated at constant or variable speed. In particular, the recent availability of very fast variable speed drivers for electrical machines, with internal control clock<1 ms, i.e. significantly faster than the typical fluid-dynamic phenomena occurring into a compressor, allows to use the electrical machine as a sensor for the fluid-dynamic machine. This is proposed in this invention for the first time. In fact, the presence of such drivers, in some cases referred to as inverters, allow to accurately know the phase angle between current and voltage in alternated current applications, therefore allowing a very accurate and fast estimation of torque from electrical parameters. The compressor can be of any dynamic type, such as axial, centrifugal, mixed-flow, or axial-centrifugal compressor. Furthermore, the compressor may include variable angle vanes: if such devices are placed at compressor intake, they are typically named IGV. If present, the angle of variable vanes should be included as separate parameter in the following formulas. In the following, compressor surge or compressor stall will be used as synonymous, indicating unexpected compressor time-dependent behavior involving the occurrence of non-stationary fluid dynamic phenomena such as rotating stall, mild surge, deep surge, etc. In general, compressor surge and stall occur at mass flow rates near the compressor stability line (or compressor surge line), or at smaller mass flow rates, causing non-stationary fluid-dynamic phenomena, augmented mechanical vibrations, higher acoustic emissions and shaft torque variations. Ultimately, the approach proposed here allows to detect anomalous torque variations. Furthermore, similar effects may also be driven by mechanical damage or object ingestion, and therefore can also be detected by this new invention.

In particular, the present invention brings forward two main innovations: (i) a new compressor map representation based on electrically-related quantities, obtained from the electrical machine or sensed by dedicated sensors, and (ii) a method to identify the compressor operating point onto such new maps as well as to detect unstable compressor operation. The new theoretical approach to compressor map representation uses the similitude theory through pseudo-dimensional parameters based on electrical signals, obtained from the electrical machine used as a sensor for the fluid-dynamic machine or sensed by dedicated sensors: this allows to use the electrical signals for compressor surge margin estimation, without lacking generality and improving accuracy. The present invention can achieve a reliability level in monitoring the compressor surge margin comparable or superior to conventional approaches with the advantage of avoiding any delicate or expensive sensor, such as a mass flow meter, and bringing reduced complexity, lower cost and enhanced robustness or redundancy.

Moreover, the present invention uses the same electrical signals to quantify the compressor surge margin, i.e. the distance from the compressor stability line, and to detect compressor surge precursors and/or surge occurrence, without requiring additional vibro-acoustic sensors, as extensively done in conventional approaches. As preferred embodiment, such electrical signals are treated by electronic analogous operators to obtain a surge detection signal, which may be used for alarming or control actions. In one embodiment, the acquired electrical signals may provide themselves the required power to obtain the surge signal; in another embodiment, a low voltage external power supply may be included, to amplify the surge detection signal, thus improving sensibility. In both the previous embodiments, analogous/digital conversion and high speed microprocessors may be avoided, with significant advantages for system simplicity, reliability and durability.

In another preferred embodiment, the electrical signals may be converted to digital signal and processed by a microprocessor, to refine the data analysis and obtain the same or additional information about the compressor performance. In both analog and digital cases, the proposed approach is general and does not need to be online tuned to specific compressors, for instance for determining thresholds for detecting surge. In fact, the threshold for surge detection is just above the signal noise, since during normal operation, the signal used for surge detection is ideally zero.

DETAILED DESCRIPTION OF EMBODIMENTS OF THE INVENTION

The present invention proposes a new approach to the monitoring of compressors mechanically connected to at least one electrical machine, so that electrical signals from the electrical machine can be used to identify the compressor operating point into a new "electrical"-based map, overcoming the limitations of state of the art in detecting the compressor surge and its precursors.

Figure 1:
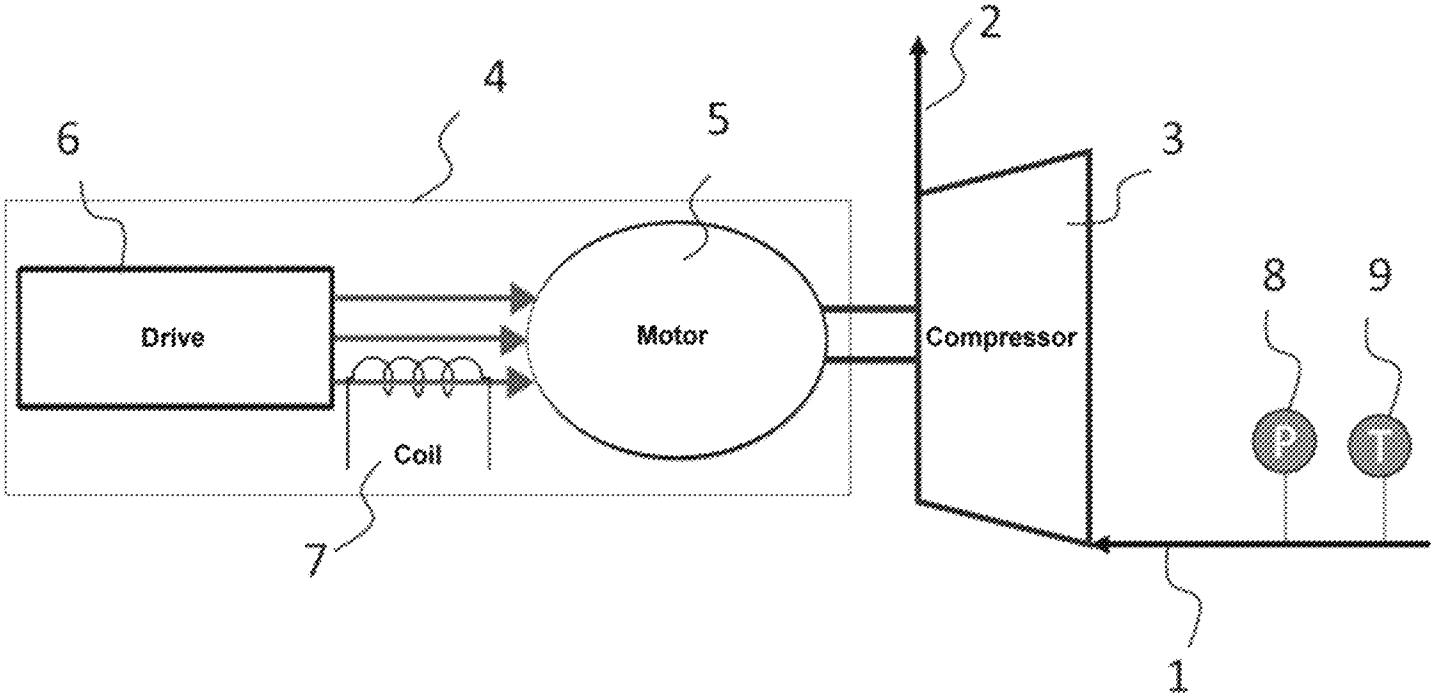
FIG. 1 shows an assembly of an electrical system, compressor and instrumentation.

With reference to FIG. 1, a fluid is processed from a low pressure level (1) to a high pressure level (2) by a compressor (3). Such a compressor is powered by an electrical system (4), which is typically constituted by an electrical machine (5) connected to a driver (6). Such a driver may be constituted by an inverter, for variable speed applications, or may be constituted by the electrical grid, for constant speed applications: such a driver is characterized by clock times much faster (e.g. <1 ms) than the compressor fluid-dynamic stall and surge phenomena (e.g. >1 ms). The connection from the driver to the electrical motor includes at least one electrical phase, where AC electrical current passes. The electrical current exchange between driver and electrical motor allows to move the compressor at a given rotational speed N. Such an electrical current value can be sensed with different means as known in the art, included but not limited to a coil (7) mounted around the electrical phase conductor: such a coil needs to have at least one full circle of conductive wire around the conductor. At the extremes of the coil, an alternating voltage signal occurs, Vin, because of the AC electrical current. The root mean square (RMS) value of such an alternating voltage signal is proportional to the AC electrical current RMS value, therefore representing a measurement of the current itself. By knowing the configuration and properties of the electrical system (4), measuring the coil alternating voltage Vin it is possible to obtain the mechanical torque provided by the electrical motor (5) onto the compressor (3). For DC operating compressors, an alternative can be a current meter based on Hall Effect.

To measure the compressor speed, in case of constant speed application, its rotational speed is known and/or determined by the electrical grid. In case of variable speed applications, the motor speed can be either obtained from the driver itself or measured basing on the RMS voltage between the electrical phase conductor and neutral conductor (the combined information of current RMS value and voltage RMS value, together with electrical motor stator resistance, allows the accurate estimation of electrical motor rotational speed). So, the rotational speed is known.

Once mechanical torque (Tor) and rotational speed (N) are known from the electrical signals, the original similitude theory applied to dynamic compressors (equation 2) can be re-formulated as it follows, in terms of pseudo-dimensional parameters:

$$\beta, \eta, \frac{Tor}{kp_{0in}} = F\left(\frac{\dot{m}\sqrt{ZRT_{0in}}}{p_{0in}} \Big/ \dot{m}_{crit}, \frac{N}{\sqrt{kZRT_{0in}}}\right) \tag{5}$$

(all symbols are detailed at the end of the present description).

Remarkably, in the above formulation, the reduced torque term $$Tor_{red} = \frac{Tor}{kp_{0in}}$$

includes, at the denominator, the specific heat ratio k and inlet total pressure: this formulation including the reduced torque which preferably can be directly measured from the electrical machine (without the use of any complex mechanical torque-meter) allows to overcome the lack of generality of existing approaches, and allows to accurately represent the compressor performance map, properly incorporating the influence of inlet composition and inlet pressure. Given the recent availability of very fast variable speed drivers, significantly faster than the fluid-dynamic effects in the compressor, the torque measured from electrical signals can be considered fully representative of the fluid-dynamic phenomena, also in time-dependent conditions, without distortions, aliasing or bias due to driver control logics. On the other hand, inlet total temperature is already included in the reduced mass flow and reduced speed formulation, according to conventional approaches.

By swapping reduced torque with reduced mass flow, the above equation becomes:

$$\beta, \eta, \frac{\dot{m}\sqrt{ZRT_{0in}}}{p_{0in}} \Big/ \dot{m}_{crit} = F\left(\frac{Tor}{kp_{0in}}, \frac{N}{\sqrt{kZRT_{0in}}}\right) \tag{6}$$

Therefore, it is apparent that once reduced torque and reduced speed are known, the operating point of the compressor is unequivocally determined, without requiring any direct measurement of mass flow. The only missing information is inlet pressure and inlet temperature, which may be conventionally measured at compressor intake through probe (8) and probe (9), respectively.

Finally, in order to obtain a new compressor map representation in terms of electrical machine-derived parameters, but retaining a straightforward interpretation with more conventional fluid-dynamic parameters, from similitude theory considerations, it can be concluded that reduced mass flow is well represented by the ratio of reduced torque and reduced speed, while pressure ratio is well represented by reduced speed at an exponent greater than 1 (the best-fit exponent to obtain a linear relationship depends mainly on k value of the working fluid; for relatively constant values of k across the compressor operating range, the best-fit exponent value depends only on k value; the exponent typical values are in the range [1; 10] and good results have been observed in the range [2; 10]). Therefore, the previous functional relationship is eventually formulated as it follows:

$$\beta, \eta, \dot{m}_{red} \approx F(Tor_{red}/N_{red}, N_{red}^{exp}) \tag{7}$$

In this way, several advantages are obtained: the compressor performance map has a general validity, invariant with respect to the inlet conditions and fluid composition; it is based on electrical parameters derived from the electrical machine, employed as compressor sensor and therefore avoiding the use of expensive and intrusive probes such as mass flow meters; the independent pseudo-dimensional variables (second member of equation (7)) show a straightforward interpretation in terms of physical parameters; it retains high accuracy also in the time-dependent domain, thanks to the very fast variable speed driver connected to the electrical machine.

Figure 2:
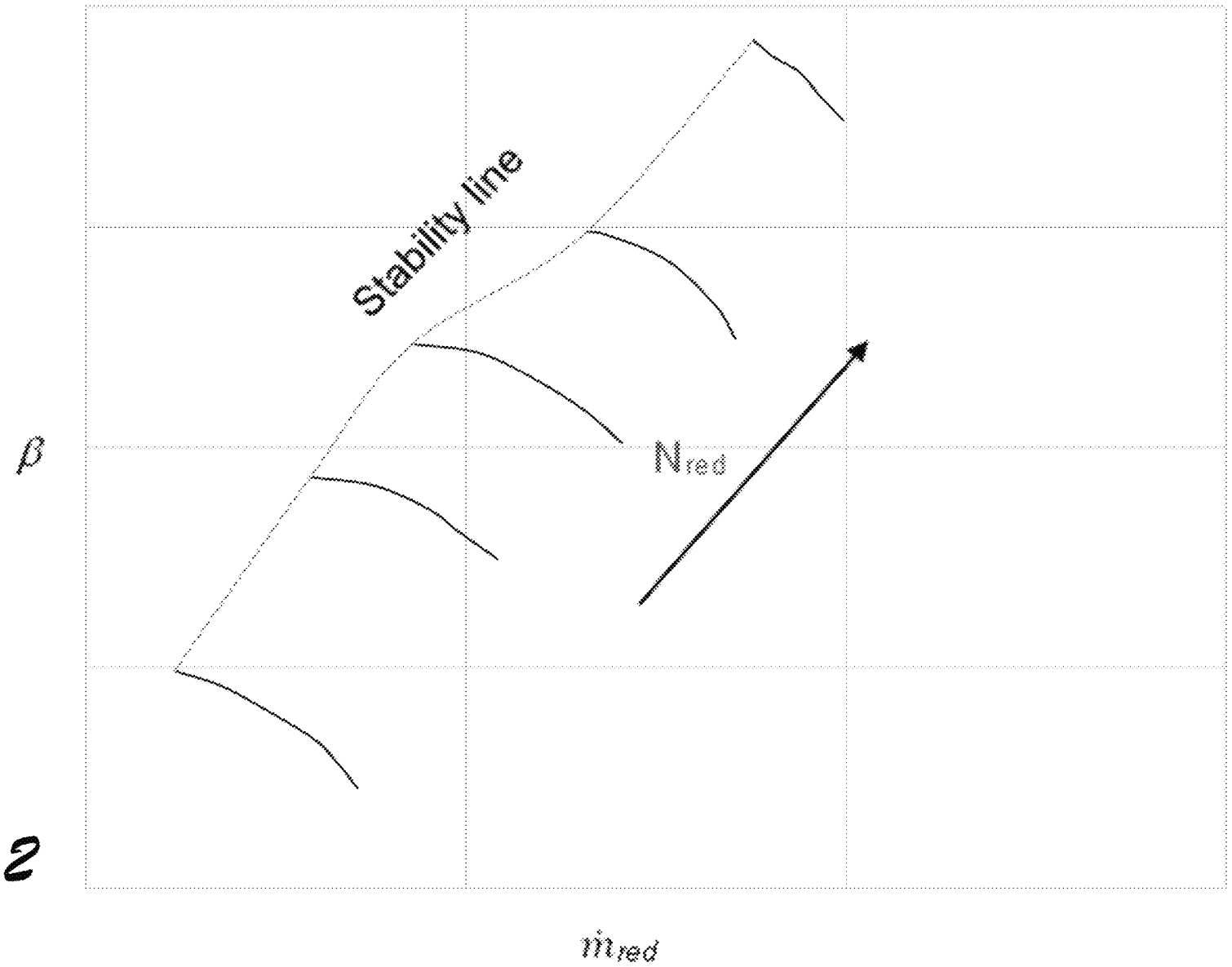
FIG. 2 shows a typical compressor map, with reduced mass flow (x axis) and pressure ratio (y axis), reduced speed as parameter.
Figure 3:
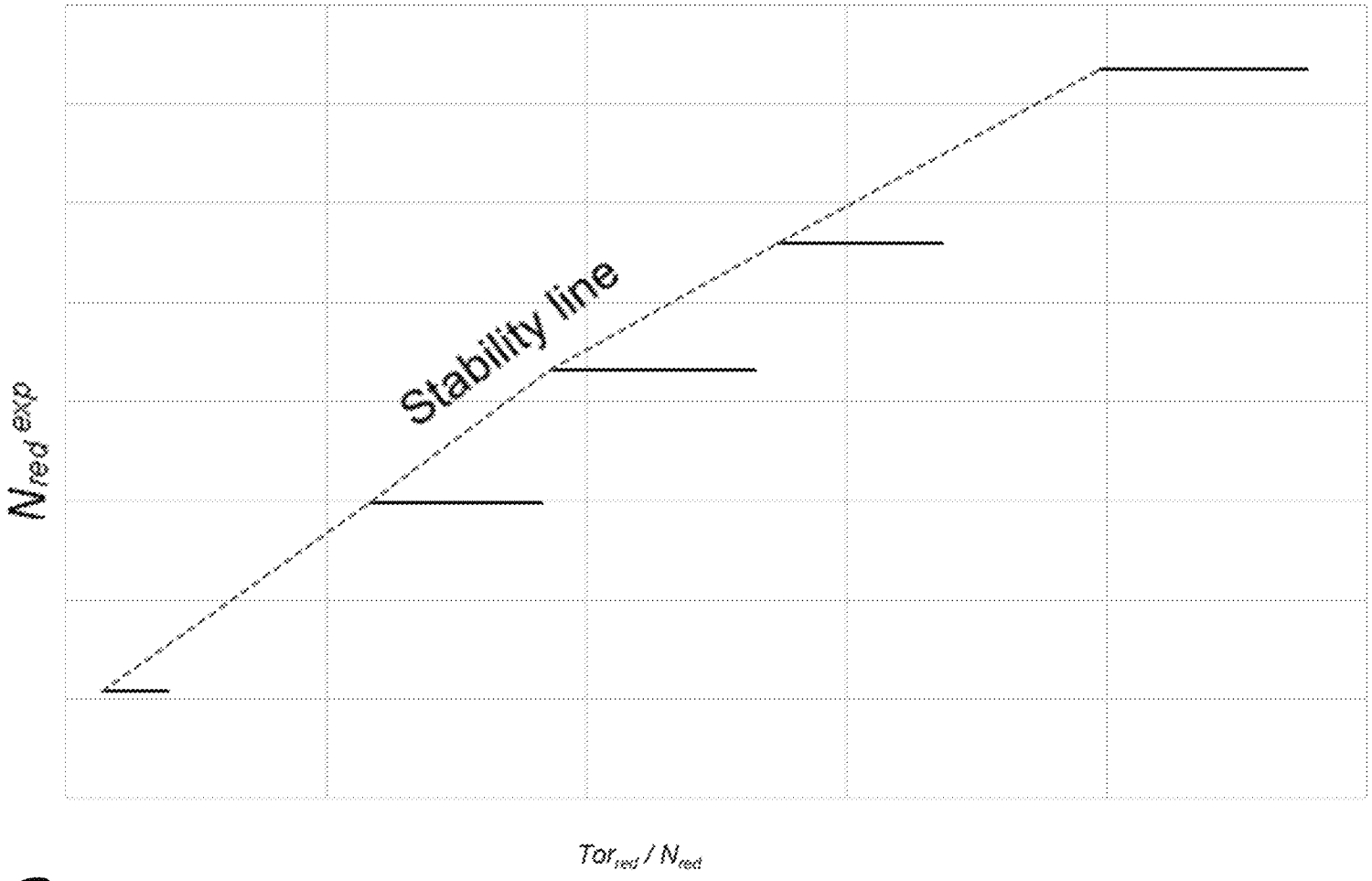
FIG. 3 shows a new compressor map, with reduced torque speed ratio (x axis), reduced speed at exponent (y axis), reduced speed as parameter.

The goodness of such a new compressor map can be inferred from FIGS. 2 and 3: the former presents the performance map of a typical radial compressor with conventional parameters and processing a real-gas behavior fluid, while the latter shows the same performance on this new "electrical" compressor map. Indeed, the stability line even shows a much more linear behavior, promising good predictability and controllability.

Figure 4:
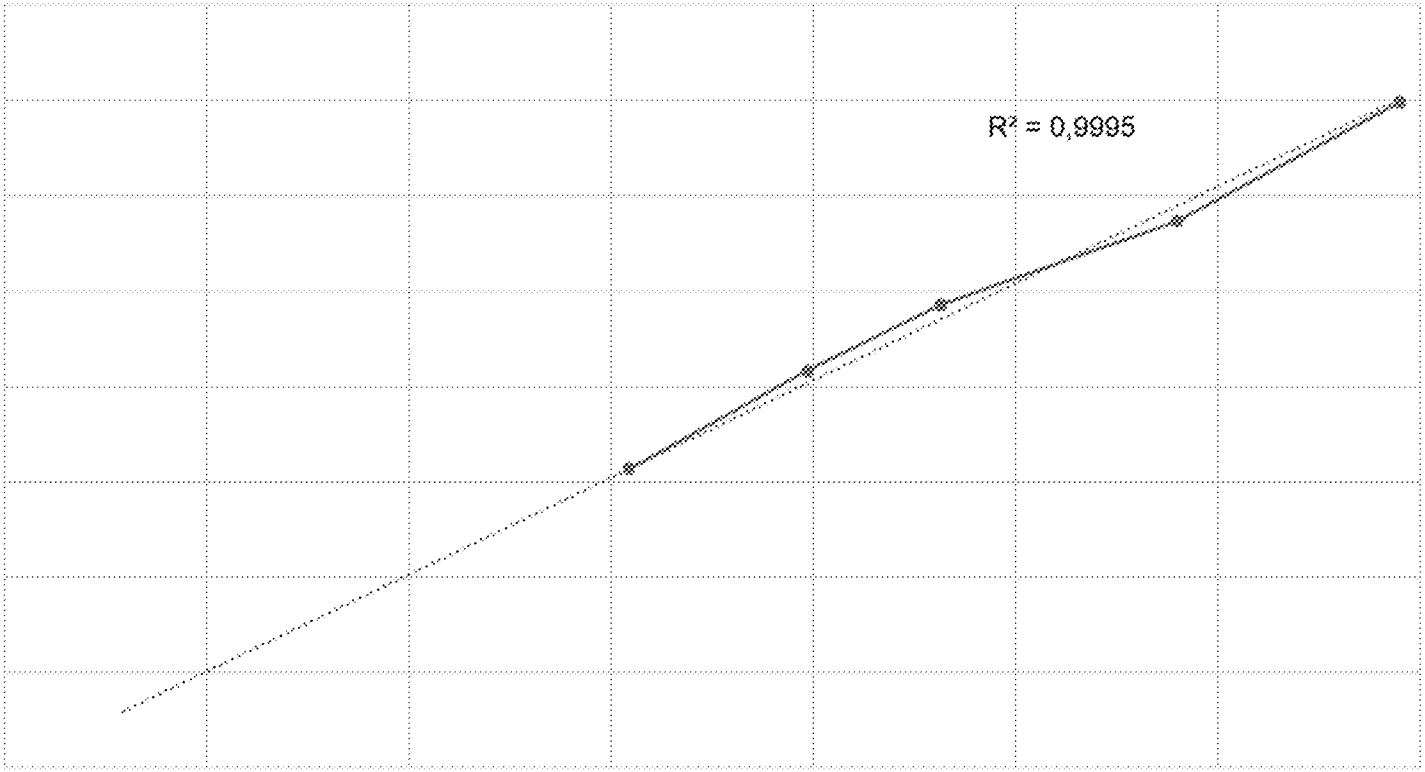
FIG. 4 shows a compressor map along the stability line: reduced torque speed ratio versus reduced mass flow.
Figure 5:
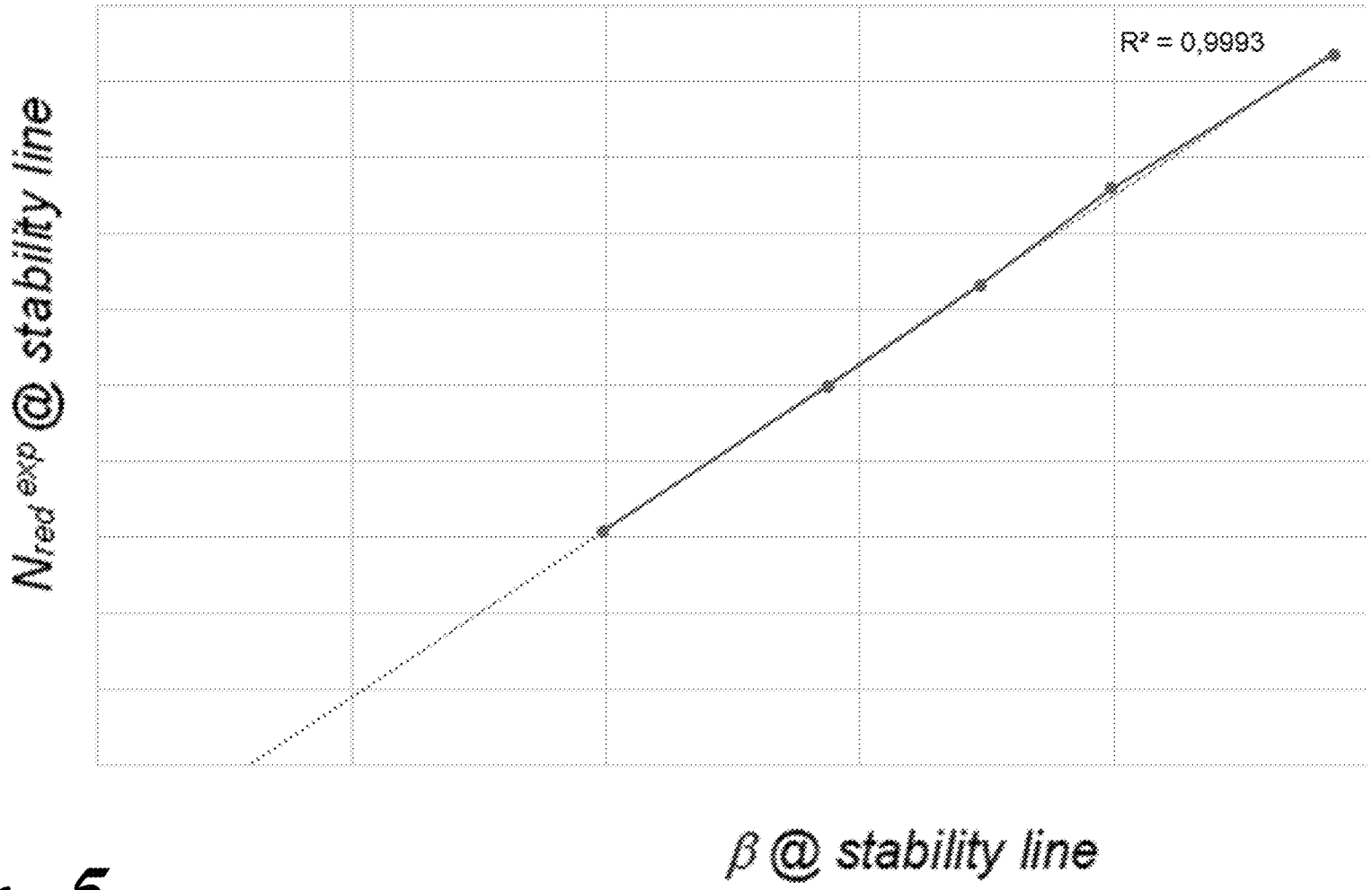
FIG. 5 shows a compressor map along the stability line: reduced speed at exponent versus pressure ratio.

FIGS. 4 and 5 demonstrate the excellent physical interpretation of the proposed "electrical" parameters, namely the reduced torque speed ratio, as reduced mass flow indicator, and the reduced speed at exponent, as pressure ratio indicator. In fact, in both cases a very accurate linear regression is possible, as demonstrated by the regression parameter $R^2$ very close to one (the experimental points considered are the last stable operating points along an iso-speed line, i.e. along the stability line of FIG. 2). Hence, the reduced torque speed ratio presents a sensitivity to compressor surge similar to reduced mass flow, while the reduced speed at exponent presents a sensitivity to compressor surge similar to pressure ratio. So, any linear combination of them can be used to define compressor surge margin estimators with very good linearity with respect to physical parameters, allowing straightforward interpretation and effectiveness in control actions.

This invention for surge margin estimation provides improved surge monitoring and control to the traditional stand-alone surge controllers. This alternative does not use four fluid sensors (inlet temperature, inlet pressure, outlet pressure, mass flow), or three fluid sensors such as in [C] (inlet temperature, inlet pressure, outlet pressure) but it uses only two physical sensors (inlet temperature, inlet pressure) plus electrical signals, promising higher reliability and lower cost. Furthermore, for those compressors mechanically connected to electrical machines already mounting conventional anti-surge apparatus, this invention may be installed as a cost-effective redundancy, contributing to system reliability.

Using the aforementioned coil, the voltage signal at its extremes, Vin, can be used for assessing the compressor surge margin according to the new "electrical" compressor map approach, previously explained, and it can also be employed for detecting compressor incipient unstable behavior, such as rotating stall, as well as surge cycles. However, as mentioned, the coil is only one of the possible ways to detect a signal representing the current intensity which drives the compressor and other alternative means for detecting such signal can be used by the skilled person.

Compressor incipient unstable behavior can be precisely detected especially while employing variable speed drivers operating with internal control clocks much faster than the fluid-dynamic phenomena occurring in the compressor: in this way, both steady-state as well as time-dependent electrical signals are representative of fluid-dynamic phenomena only, thanks to the separation in frequency ranges between the signals related to said fluid-dynamic phenomena and the signals related to electrical/electronical phenomena of the compressor driver; preferably the driver should be selected so that the clock speed (Hz) is one order or magnitude greater than the observed physical phenomena signal frequency.

Figure 6:
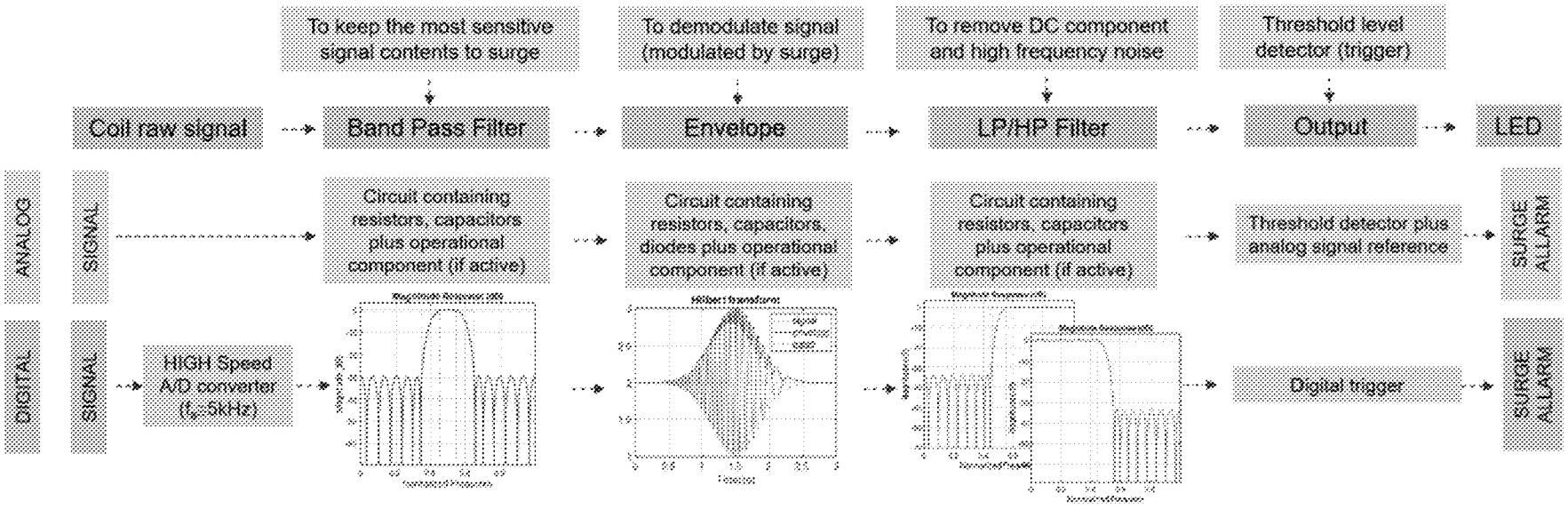
FIG. 6 shows an algorithm for compressor surge detection through coil signal processing via analog or digital electronics.

It is well known that when a dynamic compressor enters surge, the blade profiles stall and therefore the fluid cannot be anymore pushed from the low pressure inlet (1) to the high pressure outlet (2): in certain circumstances, the flow even reverts (negative flow direction), until the outlet pressure decreases and the compressor is capable again to push the fluid to the correct direction (positive flow direction). Surge occurs with the establishment of such recursive cycles of high-low positive flow or even positive-negative flow and is accompanied by strong variations in mechanical torque. As previously discussed, the measured voltage Vin at the coil (7) extremes is a direct function of electrical current exchanged between electrical motor (5) and drive (6), which is also a direct function of mechanical torque. Therefore, it is apparent that rapid variations in torque would result in rapid variations in Vin. According to this principle, it is possible to design a procedure for properly processing Vin signal until an effective and robust signal of surge precursor or occurrence is obtained, "surge alarm" in the following. FIG. 6 describes the logical path to obtain such a robust surge alarm:

(i) the raw coil signal is filtered with band-pass filter in order to retain the most significant contents, in particular around the rotating frequency;

(ii) the filtered signal needs to be demodulated, in order to clearly identify any change in electrical current RMS value;

(iii) the demodulated signal is then filtered with a low-pass filter to remove DC component and a high-pass filter to remove noise;

(iv) the resulting signal is compared with a threshold in order to provide a surge alarm in case the threshold is overcome, for instance by lighting a LED.

It should be highlighted that the threshold of (iv) can be null or very small, since during normal operation, regardless of the rotational speed or electrical current value, the signal from step (iii) will be zero voltage signal, unless background noise. This holds since surge detection is done by monitoring the energy variation of a dynamic component in response signal whose energy is negligible in normal operation. Therefore, threshold just needs to be above the remaining background noise, as it is not linked to any physical parameter: in other words, it does not need tuning on the specific compressor.

Figure 8:
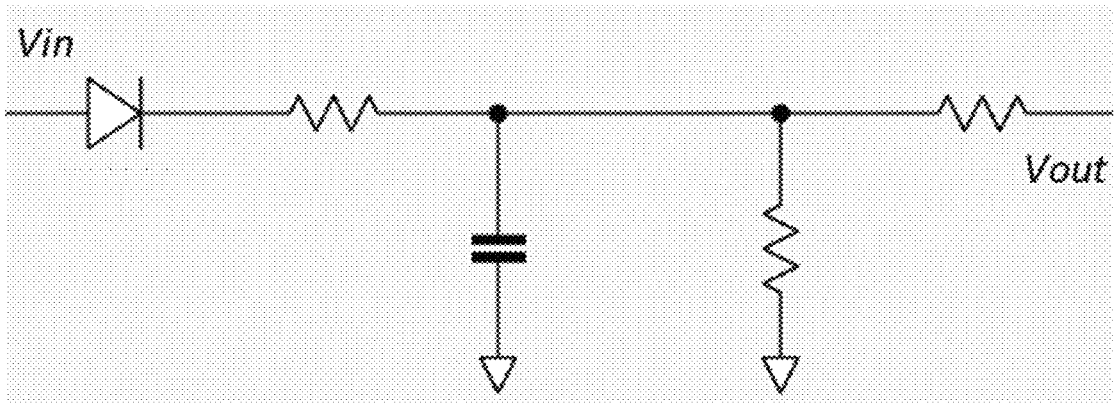
FIG. 8 shows compressor surge detection through coil signal processing via analog electronics without signal amplification (passive): circuit and results.
Figure 8:
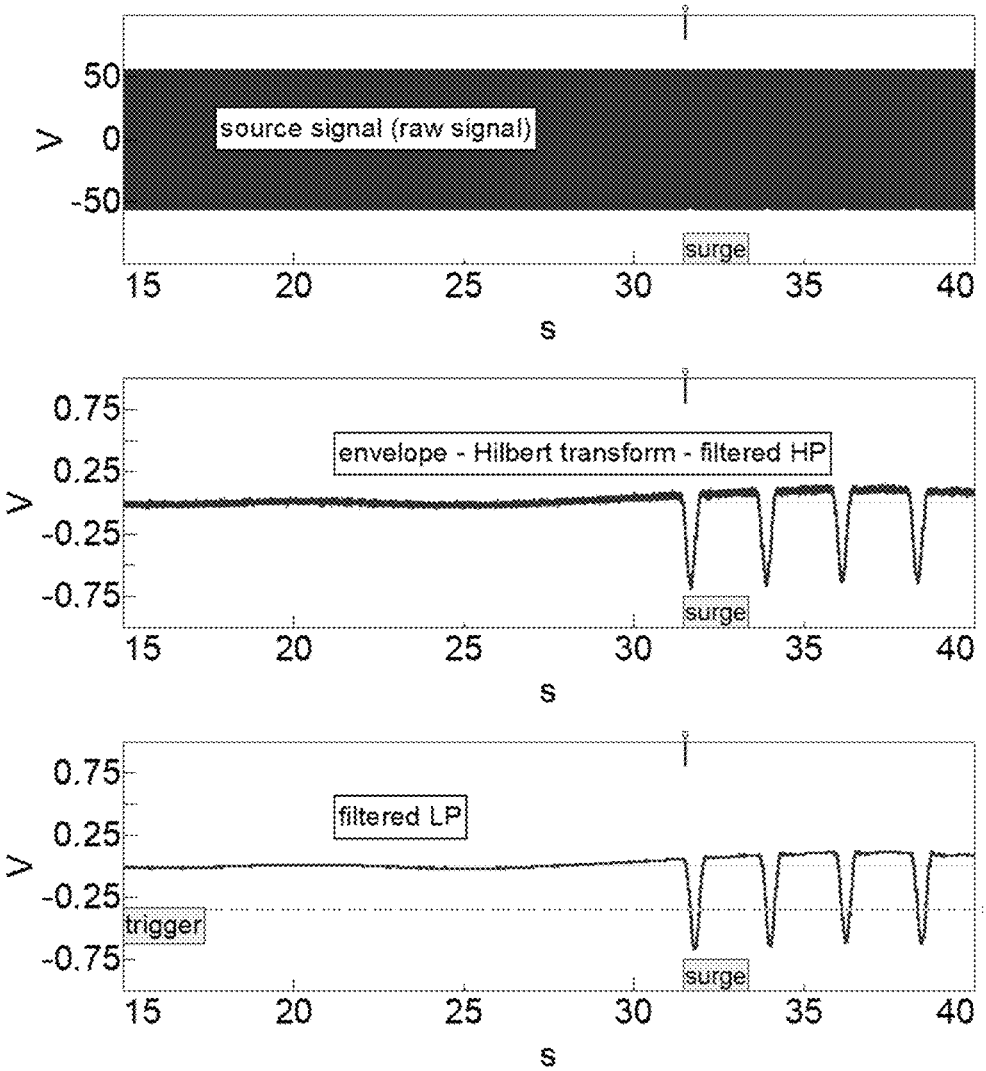
Figure 9:
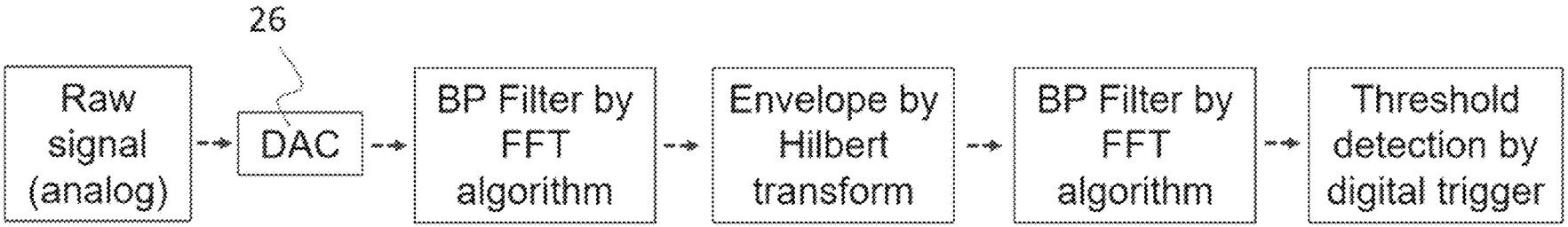
FIG. 9 shows a compressor surge detection through coil signal processing via digital electronics: logical steps.

The signal processing depicted above can be performed either through analog electronics (FIG. 7 Active electronics with amplifiers and FIG. 8 for passive electronics) or through digital electronics (FIG. 9).

Figure 7:
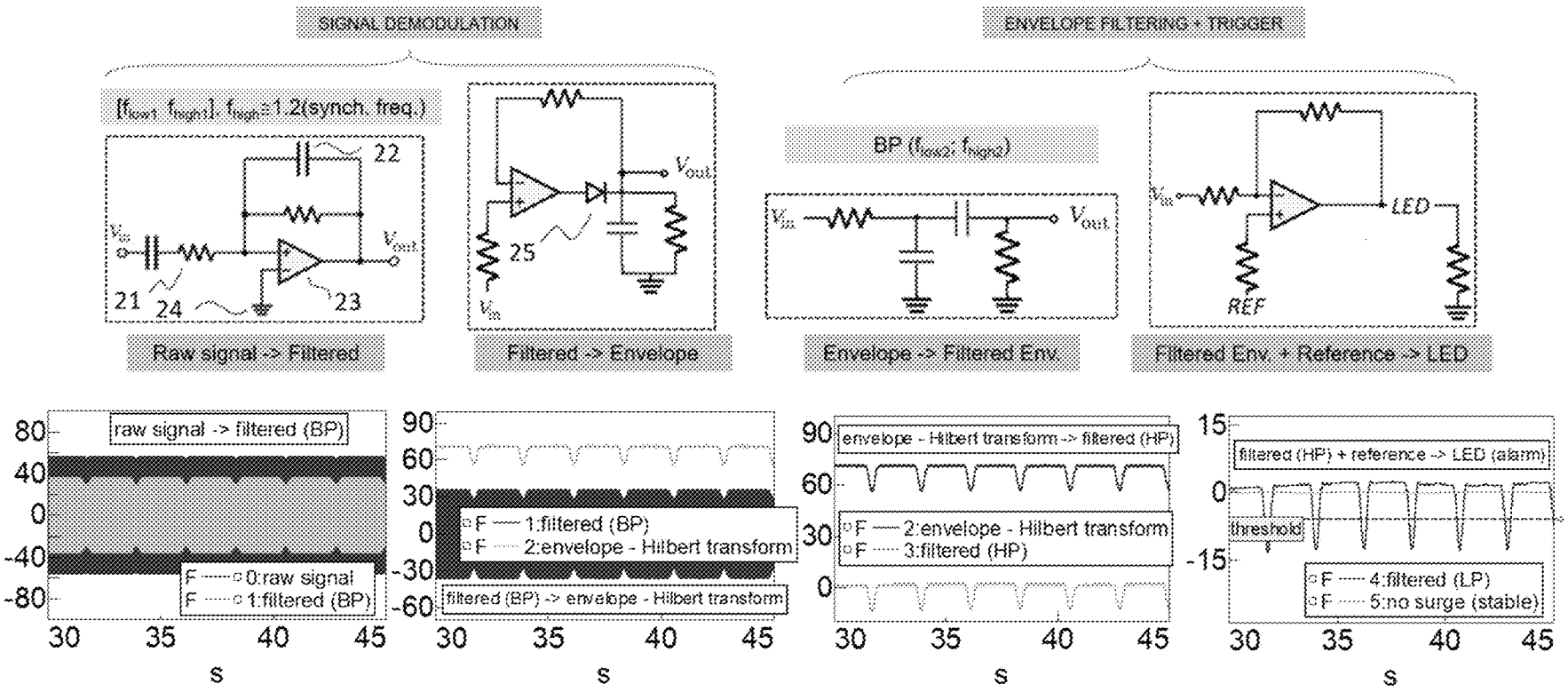
FIG. 7 shows a compressor surge detection through coil signal processing via analog electronics with signal amplification (active): circuits and results.

In case of active electronics, FIG. 7, the analog circuits rely on standard electronic components, such as resistors (21), condensers (22), operational amplifiers (23), ground connections (24) and diodes (25). The previous components electrical characteristics must be defined in order to correctly act on the input raw signal according to the desired analogic operations for compressor surge diagnostics. In sequence, the first circuit is an active pass-band filter which allows to keep a significant energy level in an enough broad frequency band around nominal synchronous frequency. The second one allows to extract the envelope of the filtered signal, which is representative of energy trend in the frequency band of interest of the filtered signal. The third one is a high-pass filter which allows to obtain a zero-mean value signal. The fourth one is a low-pass filter necessary to remove the undesired high frequency noise. Operational amplifiers are employed in order to keep a well distinguishable signal even in on-field applications, where background noise may cover the signal of interest.

The passive electronics solution (FIG. 8) is similar to the active one but without amplification stages. The logical scheme is the same of the active one (the operational sequence is maintained identical: BP filter, envelope, HP/LP filter), the differences are mainly related to the absence of operational elements which in active solution allow to amplify the signal after each operation in order to maintain good signal/noise ratio through the whole process. The advantage of the passive solution is its independence from any external power supply (e.g. battery or DC voltage source), its robustness and resilience for industrial applications. Such advantages are counterbalanced by a lower voltage in the resulting signal, which may be more sensitive to external disturbances and therefore with higher risk of false positive alarms.

FIG. 9 is based on the equivalent digital approach, relying on numerical signal processing algorithms. In this case, an analog digital converter DAC (26) is required in order to be able to apply digital signal processing algorithms (e.g. FFT routine). This approach has the advantage to be applicable to any type of coil input signals, without requiring the modification of the computing hardware, and just requires different parameter settings. However, it requires the onsite installation of sufficient computational resources to perform the required signal processing, which may hinder the application in some specific cases.

The explained surge detection technique just uses electrical signals which are readily available with high accuracy and fast response, compared to fluid sensors, and does not require installation of additional fast-response accelerometers and related signal acquisition system, for any compressor mechanically connected to electrical machines. In fact, the use of the electrical driver current ensures almost instantaneous reaction to motor torque changes, and, in case of variable speed driver, it typically executes its control algorithm at synchronous frequency.

For those compressors that already adopt a conventional surge control, the invention offers a cost-effective redundancy contributing to system reliability.

From the above description, it is therefore clear that the system and method according to the invention fully achieves the intended purposes.

The object of the invention is susceptible to numerous modifications and variations, all of which fall within the protection scope as defined by the claims. All the details can be replaced by other technically equivalent elements, and according to the needs, without departing from the scope of the present invention.

Even if the object has been described with a particular reference to the annexed figures, which are used to improve the comprehension of the invention, this does not constitute any limitation to the scope of protection as claimed.

Nomenclature $c_p$ specific heat at constant pressure [J/kg K]
$c_v$ specific heat at constant volume [J/kg K]
D diameter [m]
h enthalpy [J/kg] [W/m$^2$K]
k specific heat ratio ($c_p/c_v$)
Kp surge margin
$\dot{m}$ mass flow rate [kg/s]
N rotational speed [rpm]
p pressure [Pa]
Pow Power [W]
R specific gas constant [J/kg K]
T temperature [K]
Tor Tor torque [N m]
Z Compressibility factor [−]

Greek Symbols

β pressure ratio
η efficiency
ω angular speed [rad/s]

Subscripts crit critical
el electrical
eq equivalent
in inlet
is isentropic
red reduced
0 total

The invention claimed is:

1. A method of determining an operating state of a compressor, equipped with a rotor that exchanges energy with a known fluid by rotating at a speed (N) and with a driving mechanical torque (Tor), and of determining an operating point of the compressor and a distance of the operating point from a surge limit curve, the surge limit curve delimiting a stable operation zone from an unstable operation zone of the compressor, the method comprising:

defining a compressor map to be provided as a two-dimensional locus of possible operating points of the compressor and expressed as a function of a reduced mechanical torque $Tor_{red}$ of a rotor and a reduced number of revolutions $N_{red}$ of the rotor, being $$Tor_{red} = \frac{Tor}{kp_{0in}}$$

and $$N_{red} = \frac{N}{\sqrt{kZRT_{0in}}};$$

determining a surge limit curve as a set of points within the compressor map;

periodically detecting instantaneous operating parameters of the compressor during operation, from: mechanical torque of the rotor (Tor), number of revolutions of the rotor (N), pressure ($p_{0in}$) of a fluid entering the compressor, and/or temperature ($T_{0in}$) of the fluid entering the compressor;

determining instantaneous operating conditions from a value of a reduced mechanical torque ($Tor_{red}$) of the rotor and a reduced number of revolutions ($N_{red}$) of the rotor;

comparing the instantaneous operating conditions as detected with the surge limit curve within the compressor map; and generating one or more notifications about the operating state of the compressor and/or control signals of the compressor from a comparison with the preceding step.

2. The method according to claim 1, wherein the compressor map is determined as a two-dimensional map in a x-y plane having, as a first coordinate, a ratio between the reduced mechanical torque ($Tor_{red}$) and the reduced number of revolutions ($N_{red}$), and having, as a second coordinate, a mathematical power of the reduced number of revolutions ($N_{red}$) to an exponent (exp) greater than 1.

3. The method according to claim 2, wherein the exponent is between 2 and 10.

4. The method according to claim 2, wherein a value of the exponent (exp) is further determined as a function of a specific thermal ratio (k) of the fluid that exchanges energy with the compressor.

5. The method according to claim 1, wherein generating one or more notifications about the operating state of the compressor and/or control signals of the compressor further comprises defining a surge margin curve, provided as a locus of points belonging to a stable operating zone of the compressor and arranged at a known and predefined distance from the surge limit curve.

6. The method according to claim 5, wherein a distance between the surge margin curve and the surge limit curve constitutes a surge margin (Kp) and is calculated in such a way that for a same reduced number of revolutions (Nred), there is a linear relationship between a stability margin and a reduced flow rate defined as $$\dot{m}_{red} = \frac{\dot{m}\sqrt{ZRT_{0in}}}{p_{0in}} \Big/ \dot{m}_{crit}.$$

7. The method according to claim 5, further comprising:
providing the compressor as a dynamic compressor equipped with variable guiding vanes;
measuring an opening angle of the variable guiding vanes; and
replicating the compressor maps and stability limit curves as the opening angle varies.

8. The method according to claim 5, further comprising:
providing the compressor as a dynamic compressor connected to, and driven by, an electric driver;
detecting an amount of electrical current absorbed by the electric driver connected to the compressor and an electrical operating voltage of the electric driver of the compressor;
determining the driving torque (Tor) of the compressor as a function of the electric current absorbed by the electric driver; and
determining the rotation speed of the rotor (N) as a function of the electrical operating voltage and/or as a function of an operating frequency of the electric driver.

9. The method according to claim 8, wherein the step of generating one or more notifications and/or control signals comprises:
determining an electrical current signal representative of an instantaneous current of the electric driver during operation;
determining an electrical frequency signal representative of an instantaneous electrical frequency of a supply voltage of the electric driver during operation;
performing a first bandpass filtering of the electric current signal using a bandpass filter centered around the instantaneous electrical frequency of the supply voltage of the electric driver;
determining an envelope of a previously filtered signal;
performing a second bandpass filtering of a previously determined envelope signal;
comparing the signal thus obtained with a reference value or with a range of reference values; and
generating a notification and/or control signal based on a comparison obtained in the preceding step.

10. The method according to claim 8, further comprising:
connecting the dynamic compressor to, and operating the compressor by, an electric machine:
determining a time scale of compressor instability phenomena; and
using a driving system for the electric machine that drives the dynamic compressor, the driving system being of inverter type and being equipped with a control module operating with an internal clock at a frequency equal to, or greater than, at least one order of magnitude of a largest frequency of unstable phenomena of the dynamic compressor.

11. A system for monitoring an operating state of a compressor comprising a rotor, and for predicting and determining a surge state of the compressor, the system comprising:
means for detecting the operating state of the compressor in terms of mechanical driving torque (Tor) and rotation speed (N) of the rotor;
sensors to detect pressure ($p_{0in}$) and temperature ($T_{0in}$) of a fluid entering the compressor;
an electronic control unit comprising a processor and a memory where a map of the compressor is loaded, provided as a two-dimensional location of possible operating points of the compressor and expressed as a function of a reduced mechanical torque $Tor_{red}$ of the rotor and a reduced number of revolutions $N_{red}$ of the rotor, being $$Tor_{red} = \frac{Tor}{kp_{0in}}$$

and $$N_{red} = \frac{N}{\sqrt{kZRT_{0in}}};$$

a set of software instructions loaded into the memory which, when executed by the processor, carry out the method according to claim 1 for predicting and determining a surge state of the compressor; and
a module that generates at least one notification signal for the operating state of the compressor and/or a control signal for the compressor.

12. The system according to claim 11, wherein the means for detecting the operating state of the compressor in terms of the mechanical driving torque (Tor) consist of an electric current sensor for detecting an electric current absorbed by a compressor driver.

13. The system according to claim 11, further comprising an additional module for processing an electrical signal detected by the means for detecting the operating state of the compressor and the sensor to detect the pressure ($p_{0in}$) and temperature ($T_{0in}$) of the fluid entering the compressor.

14. The system according to claim 13, wherein the additional module for processing the electrical signal is of electronic type with passive and/or active components and/or is provided with digital signal processing submodules.

* * * * *